United States Patent [19]

Tanaka

[11] Patent Number: 4,684,096

[45] Date of Patent: Aug. 4, 1987

[54] MOUNTING DEVICE FOR HELMET

[76] Inventor: Akira Tanaka, No. 11-14-2A, Fukasawa 7-Chome, Setagaya-ku, Tokyo, Japan

[21] Appl. No.: 867,957

[22] Filed: May 29, 1986

[30] Foreign Application Priority Data

Jul. 4, 1985 [JP] Japan ..... 60-101278[U]

[51] Int. Cl.[4] ..... A47H 1/10

[52] U.S. Cl. ..... 248/309.1; 211/32

[58] Field of Search ..... 248/309.1, 309.2, 339, 248/340, 303, 304, 316.8; 211/30, 32, 33, 106, 125

[56] References Cited

U.S. PATENT DOCUMENTS 1,049,971 1/1913 Appleby ..... 248/303
2,577,473 12/1951 McEwen ..... 211/32 X
2,633,246 3/1953 Guthrie ..... 211/32
3,680,819 8/1972 Meland ..... 211/106 X
4,109,795 8/1978 Konigsford et al. ..... 211/57.1

*Primary Examiner*—J. Franklin Foss
*Assistant Examiner*—David L. Talbott
*Attorney, Agent, or Firm*—James E. Nilles; James R. Custin

[57] ABSTRACT

A mounting device for a helmet wherein a hook section to be fixed on a wall surface for holding a circumferential part of a helmet wearing opening has a transverse bar. The transverse bar projects to the right and left sides of the hook section at a location with a predetermined space from the wall surface, and is long enough to abut on the circumferential part of the helmet wearing opening in case of hanging the wearing opening on said hook.

4 Claims, 4 Drawing Figures

MOUNTING DEVICE FOR HELMET

BACKGROUND OF THE INVENTION

1. Field of the Invention

The present invention relates to a mounting device which is utilized for hanging a helmet, especially a motorcycle helmet, when it is not in use.

2. Description of the Prior Art

The helmet to be worn in driving a motorcycle is designed to have a pot-like hollow body that has a wearing opening for the head, a window that opens at the front surface of the body and a transparent plate attached to the window.

As a hook for hanging and fixing a motorcycle helmet as described above, there is conventionally utilized an L-like ordinary type of hook fixed on a wall surface and curved upwardly as shown in FIG. 4, but when an upper part of the wearing opening (B) of a helmet (A) is hung on this conventional hook, the wearing opening (B) is almost covered by the wall surface (W) as shown in the drawing. This means that there is no space between the end surface of the wearing opening (B) of the helmet and the wall surface (W). Thus, when the helmet (A) is taken off of the hook (H), there exists no handhold for holding the helmet. As a result, there is the disadvantage that it is necessary to lift up the helmet by both hands.

SUMMARY OF THE INVENTION

It is an object of the present invention to provide a hook to be fixed on a wall surface for a motorcycle helmet from which a helmet can be removed with one hand.

In order to achieve the above-mentioned object, the present invention relating to a hook to be fixed on a wall has a structure comprising a hook section to be fixed on a wall surface and a transverse bar, said hook section projects its hook top end almost upwardly at the forward location from the wall surface, said transverse bar is fixed with both of its projecting ends to the right and left sides of said hook section, leaving a space from the wall surface located behind and down the top end of said hook, and the transverse bar has a length long enough to abut on the opening circumference of the wearing opening when the wearing opening of the helmet is hung on said hook.

The other objects and the features will be obvious from the following description and drawings.

DESCRIPTION OF THE PREFERRED EMBODIMENTS

Figure 1:
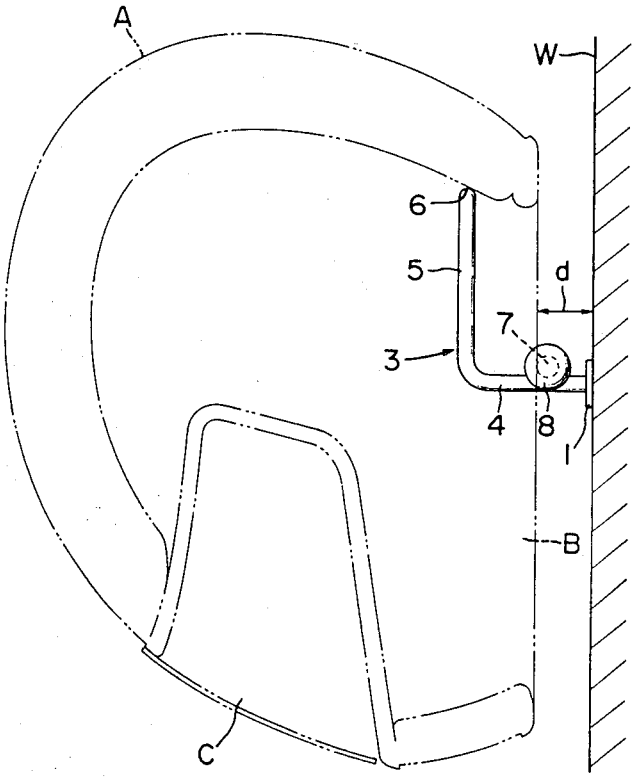
FIG. 1 is a side view showing an embodiment of the present invention.
Figure 2:
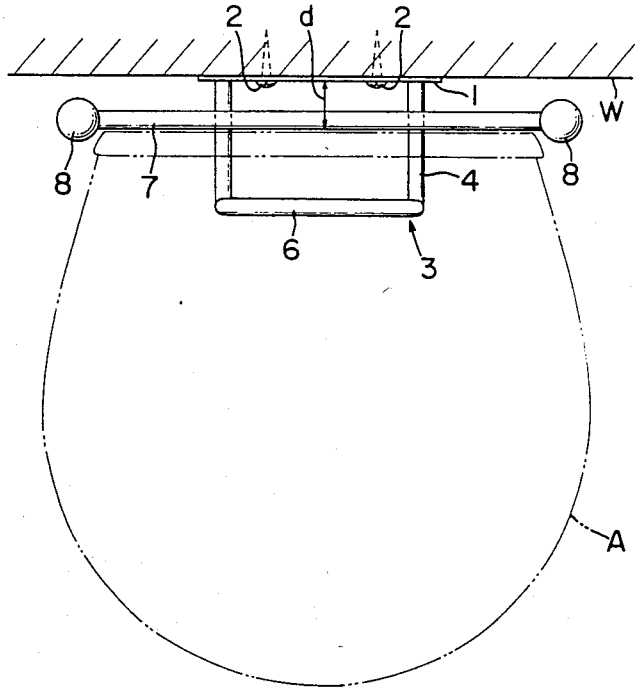
FIG. 2 is a plan view.
Figure 3:
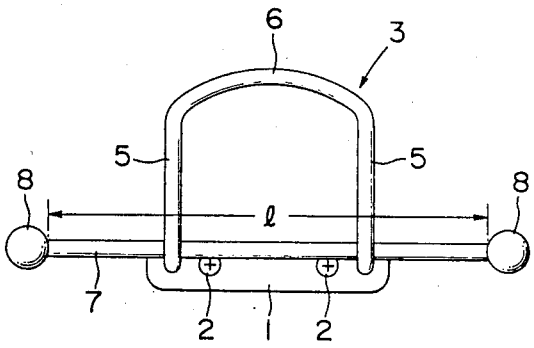
FIG. 3 is an elevation view.
Figure 4:
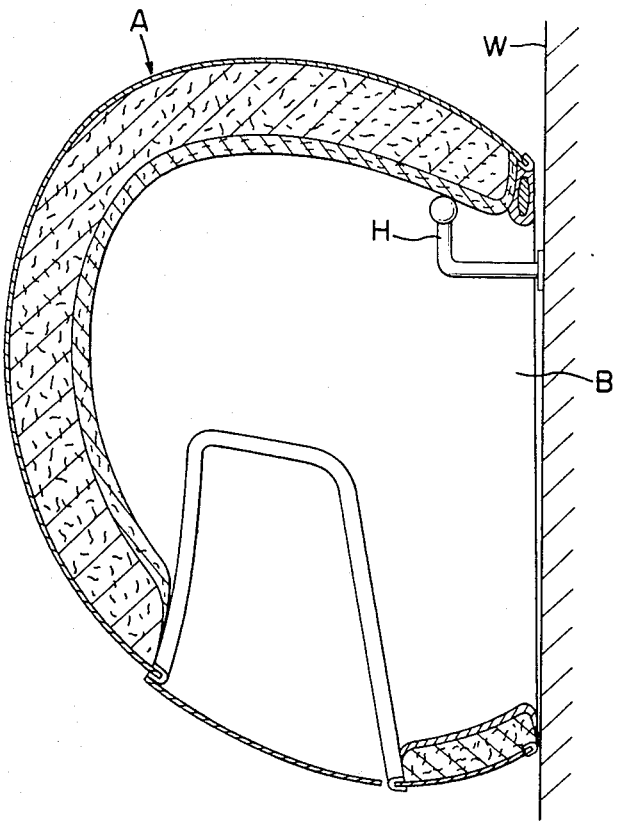
FIG. 4 PRIOR ART
FIG. 4 is a side view showing a conventional hook with a helmet (shown in section) hung thereon.

As shown in FIGS. 1, 2 and 3, a hook section (3) made of a bar member curved nearly in U-like form is fixed to the front surface of a seat plate (1) fixed on a wall surface (W) at both ends of the hook section (3) by means of screws (2) and (2). The hook section (3), by reason of being substantially U-shaped, has a pair of legs, each of which has a right-angle bend intermediate its ends to have a horizontal part (4) that projects forward from the front surface of the seat plate (1) and a vertical part (5) which projects upwardly perpendicularly to the horizontal part (4) and which is connected at its upper end to the bight portion (6) of the hook. A transverse bar (7) is fixed at an almost central portion of the horizontal parts (4) of the hook section (3) in parallel with the wall surface (W). Thus there is formed a space (d) between the front surface of said transverse bar (7) and the wall surface (W), which space is wide enough for a hand to be freely inserted into it.

The above-mentioned transverse bar (7) in this embodiment is a linear bar member. The ends of the transverse bar (7) respectively project horizontally to the right and left sides of said hook section (3) by equal distances, and there are fixed to them spheric stoppers (8), (8) whose diameters are respectively larger than that of the transverse bar (7) at its ends. The length l of said transverse bar (7) in this embodiment is somewhat longer than the diameter of the wearing opening of the helmet.

In another embodiment of the present invention, it is not necessary to employ an integral bar member as a transverse bar (7) and it is possible to employ two horizontal bar pieces fixed to the right and to the left horizontal parts (4) of the hook section (3) as the transverse bar (7).

With the window section (C) of the helmet (A) directed downward, the upper part of the wearing opening (B) of the helmet (A) is hung on the top end or bight portion (6) of the vertical part (5) of the hook section (3). In this case, as shown in FIG. 1, the circumferential edge of the helmet wearing opening (B) abuts against the transverse bar (7) and, thereby, the helmet is supported by the top end (6) of the hook with a space (d) left between said circumferential edge of said wearing opening (B) and the wall surface (W). On the other hand, as shown in FIG. 2, the right and the left portions of the circumferential edge of the wearing opening (B) of the helmet are confined at the right and the left by means of the right and the left spheric stoppers (8), (8) fixed to the transverse bar (7). Accordingly, the right and left swing of the helmet can be prevented.

When the helmet (A) is taken off of the hook, the side plate of the helmet is grasped from the inside and the outside by putting one hand in the space (d) between the helmet (A) and the wall surface (W), and then the whole helmet is lifted up so as to be removed from the top end of the hook.

EFFECT OF THE INVENTION

According to the present invention relating to the hook fixed to the wall for a motorcycle helmet, when a motorcycle helmet is hung on a hook section by the wearing opening, it is possible to leave a space between said wearing opening surface and the wall surface. Accordingly, the helmet can be grasped by putting one hand in said space so as to lift it off of the hook. The hook is very conveniently used for the helmet.

I claim:

1. A hanger for a motorcycle helmet that has a dome-like body wherein there is an opening through which a wearer's head enters the body and which is surrounded by an edge on the body, said hanger comprising a substantially L-shaped hook member having connected horizontal and vertical portions and means on a rear end of said horizontal portion for securing said hook member to an upright wall with said horizontal portion projecting forward from the wall and said vertical portion projecting upward from the horizontal portion in forwardly spaced relation to the wall to have its top supportingly engageable by an inner surface portion of the body of a helmet, near said edge thereon, said hanger being characterized by:

bar-like stop means projecting in opposite lateral directions from said hook member and having remote end portions which (1) are spaced apart by a distance greater than the distance across said opening in a helmet body, (2) are in downwardly offset relation to the top of said vertical portion, and (3) are in forwardly offset relation to said rear end of the horizontal portion, for engagement by laterally opposite portions of said edge on a helmet body to hold the same so spaced from a wall to which the hanger is secured that a person's hand can be inserted between the wall and the helmet for grasping the latter.

2. The hanger of claim 1 wherein said hook member comprises a single piece of rod-like material bent to substantially an inverted U-shape to have a laterally extending bight portion which is at the of said vertical portion and which connects a pair of parallel L-shaped legs that together define said vertical portion and said horizontal portion, each said leg having a vertical segment and a horizontal segment, further characterized by:

said bar-like stop means comprising a single straight bar secured to the horizontal segments of said legs near the vertical segments thereof and extending transversely to both of those segments of each leg.

3. The hanger of claim 2, further characterized by: a knob-like protuberance on each end of said bar, said protuberances providing abutments between which a helmet supported on said hanger is substantially confined against lateral shifting.

4. A hanger for a motorcycle helmet that has a dome-like body wherein there is an opening through which a wearer's head enters the body and which is surrounded by an edge on the body, said hanger comprising:

A. a hook element comprising (1) a pair of L-shaped legs, each of which has (a) a horizontal portion with a rear end adapted to be adjacent to an upright wall and (b) a vertical portion projecting upward from a front end of the horizontal portion to be in forwardly spaced relation to said wall, (2) a laterally extending bight portion having opposite ends to which said legs are connected at upper ends of their vertical portions to be in laterally spaced substantially parallel relation to one another and upon which an inner surface portion of a helmet body, adjacent to said edge thereon, is supportingly engageable, and (3) means at said rear ends of the horizontal portions of the legs for securing the hook element to an upright wall; and B. a bar secured to the horizontal portion of each of said legs in forwardly spaced relation to the rear end thereof and having an end portion projecting laterally beyond each leg in the direction away from the other leg, said end portions of the bar being engageable by said edge of a helmet supported on said bight portion to hold the helmet so spaced from a wall to which the hook element is secured that a person's hand is insertable between that wall and the helmet for grasping the latter near said edge thereof.

* * * * *